US005950702A

United States Patent [19]

Tan et al.

[11] Patent Number: 5,950,702

[45] Date of Patent: Sep. 14, 1999

[54] CONSUMABLE PATTERN COATING FOR LOST FOAM CASTINGS

[75] Inventors: Lian Soon Tan, Dublin; Teresa Ann DeLong, West Mansfield; Ruth Ann Bambauer, Columbus, all of Ohio

[73] Assignee: Ashland Inc., Russell, Ky.

[21] Appl. No.: 08/834,462

[22] Filed: Apr. 11, 1997

[51] Int. Cl.[6] ..... B22C 7/02; B22C 9/04

[52] U.S. Cl. ..... 164/34; 164/45; 164/249; 106/38.22

[58] Field of Search ..... 164/34, 35, 45, 164/249, 518; 106/38.22, 38.25

[56] References Cited

U.S. PATENT DOCUMENTS 4,240,492 12/1980 Edwards et al. ..... 164/34

FOREIGN PATENT DOCUMENTS

| | | | |
|---|---|---|---|
| 3-32441 | 2/1991 | Japan | 164/34 |
| 3-35443 | 2/1991 | Japan | 164/34 |
| 3-180244 | 8/1991 | Japan | 106/38.22 |
| 4-118151 | 4/1992 | Japan | 164/34 |
| 4-178235 | 6/1992 | Japan | 164/45 |

*Primary Examiner*—J. Reed Batten, Jr.
*Attorney, Agent, or Firm*—J. K. Mueller, Jr.; David L. Hedden

[57] ABSTRACT

The coated pattern is formed from a consumable pattern, preferably polystyrene, and is adapted to be decomposed and replaced by molten metal to form a casting. The improved coating is the dried residue of an aqueous coating formed from water, refractory particles, and from between about 25 wt-% and 75 wt-% organic polymer on a non-volatile solids basis (i.e., dry film basis). Lustrous carbon is reduced when casting iron.

14 Claims, 2 Drawing Sheets

CONSUMABLE PATTERN COATING FOR LOST FOAM CASTINGS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to the casting of metals by a lost foam process and more particularly to an improved coating for application to the polystyrene pattern used in such lost foam process.

The lost foam process for casting of metals is described in U.S. Pat. Nos. 4,482,000 and 4,448,235, the disclosures of which are expressly incorporated herein by reference. In such lost foam process, a polystyrene pattern is embedded in a sand mold. Molten metal poured into the mold vaporizes the polystyrene and occupies the void created thereby, thereby concurrently consuming the polystyrene pattern and forming a casting. The lost foam process is used where particularly intricate castings are to be formed. The lost foam process also can reduce the rigging required by conventional sand casting (e.g., sprues, risers, gates, downcomers, etc.).

A refractory coating typically is applied to the consumable pattern to, inter alia, thermally insulate the metal to prevent premature hardening of the metal before the entire pattern has been replaced by the molten metal. Additionally, turbulence of the metal is lessened by the insulating coating because the coating initially retards escape of the pattern decomposition vapors. Thereafter, the pattern decomposition vapors are vented from the casting through the coating and into the sand that surrounds the pattern. Such escape of the vapors proceeds by virtue of the heat from the molten metal vaporizing the organic content of the pattern coating through which the pattern vapors escape into the surrounding sand.

The '235 patent discloses the use of a first coating for the pattern which is a thermally insulative, relative gas permeable, refractory layer. A second layer is applied over the first layer and it is a vaporizable, relatively gas impermeable, polymeric layer. The refractory layer is applied as a water-based slurry and the polymeric layer as a water-based emulsion.

The '000 patent discloses a single coating for the pattern which is predominantly refractory particulates and polymeric particles vaporizable at metal casting temperatures but having a relatively low permeability to pattern decomposition vapors. A combination of polyethylene particles, xanthan gum, and calcium lignosulfonate binder is preferred.

Lustrous carbon defects in, for example, iron castings are a problem that is not addressed by the foregoing art. Lustrous carbon defects are believed to be caused by entrapped polystyrene decomposition products and typically occur on the top of the cope surface of the casting as a wrinkled skin appearance. The present invention is addressed to providing a consumable pattern coating that exhibits the desirable characteristics recognized by the art while concomitantly providing a diminution in lustrous carbon defects in metal castings manufactured by the lost foam process.

BRIEF SUMMARY OF THE INVENTION

Disclosed is an improved coated pattern for casting metal by a lost foam process. The coated pattern is formed from a consumable pattern, preferably polystyrene, and is adapted to be decomposed and replaced by molten metal to form a casting. The improved coating is the dried residue of an aqueous coating formed from water, refractory particles, and from between about 25 wt-% and 75 wt-% organic polymer, preferably a latex, on a non-volatile solids basis (i.e., dry film basis). Lustrous carbon is reduced when casting iron. An improved lost foam casting process using the novel coated consumable pattern also is disclosed.

Advantages of the present invention include the reduction of incidences of lustrous carbon in iron castings. Another advantage is that the extra organic polymer loading into the consumable casting coating slurries does not adversely affect the physical properties of the slurries nor the ability of the slurries to coat the consumable patterns. These and other advantages will be readily apparent to those skilled in this art based on the disclosure herein.

DETAILED DESCRIPTION OF THE INVENTION

Figure 1:
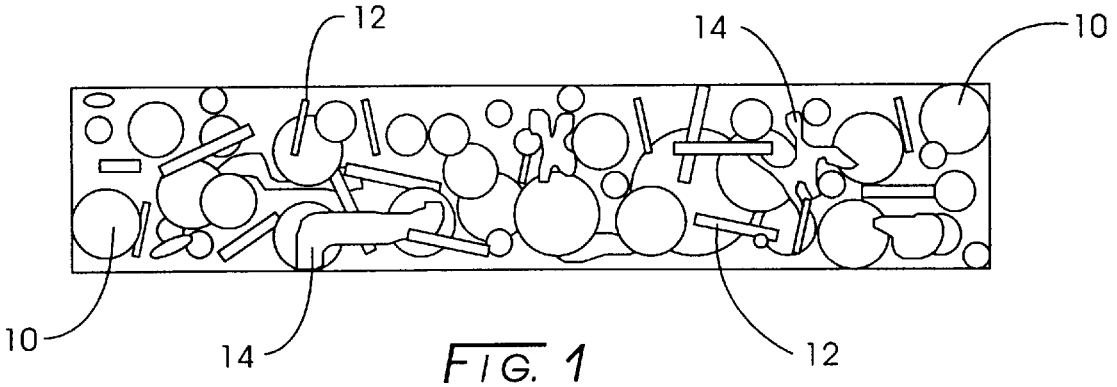
FIG. 1 PRIOR ART
FIG. 1 is a simplified representation of a conventional (prior art) dried consumable coating at room temperature.
Figure 2:
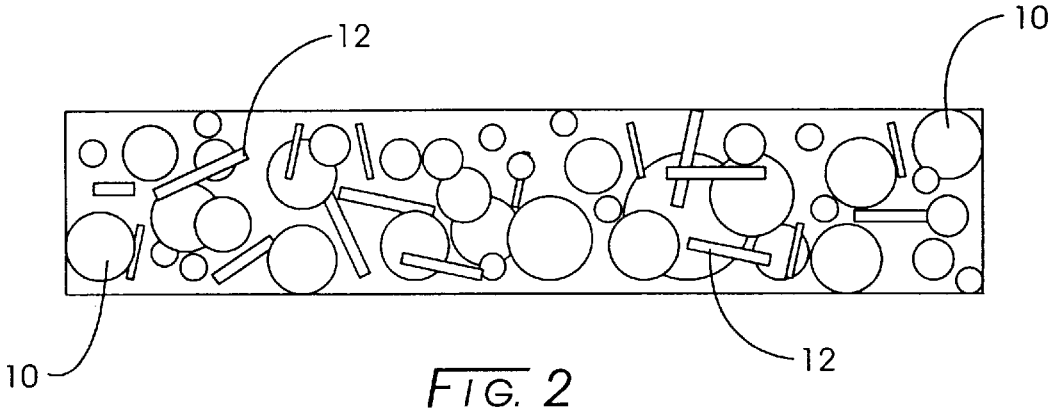
FIG. 2 PRIOR ART
FIG. 2 is a simplified representation of the dried coating of FIG. 1 at the elevated metal casting temperatures used in lost foam castings.

It is not unusual for the consumable patterns to be formed of a mixture or copolymer of polystyrene and polymethylmethacrylate. The polymethylmethacrylate is incorporated into the pattern in order to reduce incidences of lustrous carbon in the final casting. This is because the use of pure polystyrene patterns results in increased incidences of lustrous carbon during iron casting. However, the use of pure polystyrene patterns, rather than mixtures of expandable beads, is desirable from a manufacturing and a cost standpoint. The inventive latex-rich slurry enables the caster to use pure polystyrene patterns substantially diminished in incidences of lustrous carbon. Thus, the inventive slurry results in castings of improved quality.

The improved consumable pattern coatings (often referred to as slurries herein) of the present invention can be made by modifying conventional consumable pattern coatings by incorporation of latex emulsion therein. Testing on the present invention has revealed that the composition of the added latex in the latex emulsion is of little importance compared to the mere addition of latex emulsion itself. That is, latex emulsions tend to wet polystyrene, leave the relatively neutral pH of conventional consumable pattern coatings (pH of between about 6 and 8) unchanged, and can effective space apart the inorganic components in the dried film or residue of the consumable pattern coatings.

As explained in the background art, consumable pattern decomposition products escape from the molten metal by penetrating through the consumable pattern coatings and into the surrounding sand. If the inorganic components in the coating are packed too tightly, the decomposition products may not escape which would result in additional surface defects of the casting. However, permeability of the coating at room temperature, routinely measured by some manufacturers of consumable pattern coatings, is not relevant to such occurrences. Rather, permeability of the coating at the elevated temperatures of molten metal pouring (around 1,500° C. or 2,600° F.) should be considered because it is at these elevated temperatures that the coating must be permeable to the pattern decomposition products.

Any material added to the consumable pattern coating also should not adversely affect the ability of the coating to coat the pattern (i.e., wet the polystyrene). Any material added to the consumable pattern coating further should not adversely change the physical characteristics of the consumable pattern coating e.g., rheology) or alter the pH of the coating so as to destabilize it. The desirable consumable pattern coating characteristics (as taught by the art) of being insulative and initially being less permeable (to permit liquid polystyrene, which may tend to pool ahead of the advancing molten metal, to vaporize) also should be maintained.

In order to meet these diverse criteria, it was unexpectedly discovered that addition of substantial quantities of latex emulsion to the consumable pattern coating slurry resulted in a consumable pattern coating that met such criteria. Conventional consumable pattern coating slurries often have a component of a latex emulsion which serves as the binder for the system (binding the inorganic components and forming a continuous film which effectively coats (wets) the polystyrene pattern). Moreover, the addition of extra quantities of latex emulsion will not change the physical properties of the consumable pattern coating slurry in terms of its rheology and other properties. Still further, the inventive consumable pattern coating slurries quite effectively wet pure polystyrene patterns. Improvement in casting quality is seen at increasing dilutions of the inventive consumable pattern coating slurries compared to the conventional counterpart consumable pattern coating slurries sans the extra quantity of added aqueous latex emulsion, as the examples will demonstrate.

Thus, conventional consumable pattern coating slurries should have the amount of latex emulsion at least doubled with additions of up to ten times the original latex emulsion content resulting in improved consumable pattern coating slurries in accordance with the precepts of the present invention. It should be understood that all discussions involving amounts of the latex or other components in the consumable pattern coating slurries involve the solids content therein, i e., the non-volatiles solids content of the latex component. In terms of the absolute quantity of latex that should be present in the inventive consumable pattern coating slurries, such amount can range from about 25 wt-% to about 75 wt-% on a non-volatiles solids basis (i.e., the solids in the coating slurry that are in the dried film).

Without being bound by theory, it is believed that the increased quantity of latex in the dried coating adhering to the consumable patterns results in increased porosity at the elevated temperatures of molten metal pouring, thus permitting enhanced escape of consumable pattern volatiles therethrough and into the surrounding sand. At the inception of the pouring operation, the increased quantity of latex in the dried coating does not contribute to a diminution in the insulative qualities of the dried coating and favorable contributes to an initial recalcitrance to permeability of the coating, as taught advantageous by the art. This action, perhaps, can be better understood by reference to the drawings. FIG. 1 represents a conventional consumable pattern dried coating at room temperature with the refractory particles being identified as at items 10 and 12 with the dried latex being identified as at item 14. At the elevated temperatures of molten metal pouring, latex component 14 has been volatilized to leave refractory particles 10 and 12 with porosity being created by the removal of latex 14. It is through such porosity created by the burning out or volatilization of latex 14 that the consumable pattern volatiles are believed to escape into the surrounding sand.

Figure 3:
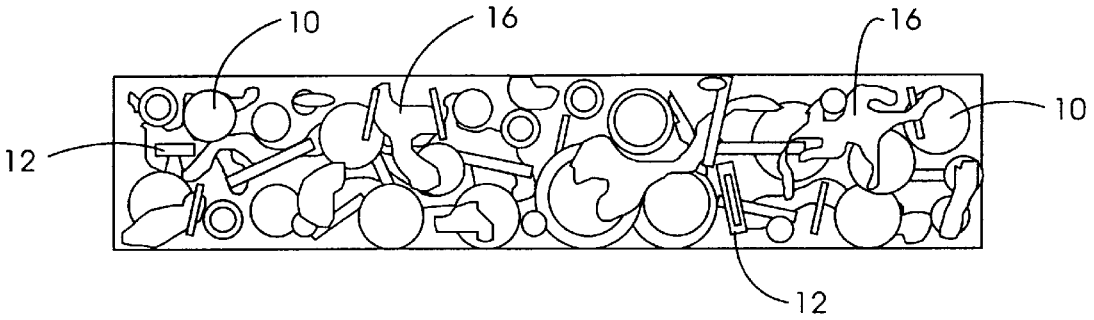
FIG. 3 is simplified representation of the inventive dried consumable coating at room temperature.
Figure 4:
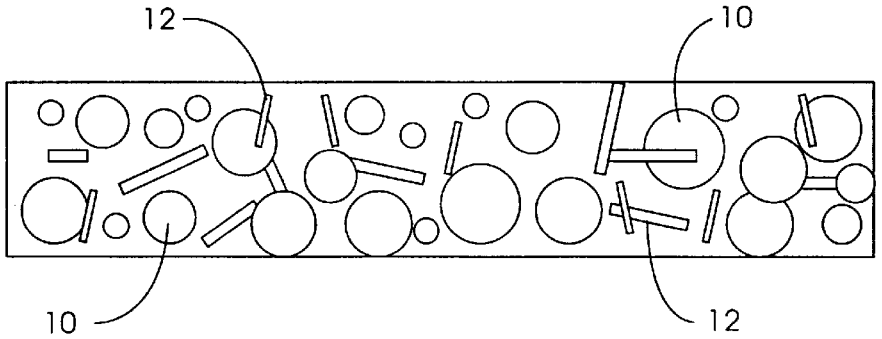
FIG. 4 is a simplified representation of the dried coating of FIG. 3 at the elevated metal casting temperatures used in lost foam castings The drawings will be described in detail below.

FIG. 3 represents the inventive consumable pattern dried coating at room temperature with the refractory particles being identified as at items 10 and 12 with the dried latex being identified as at item 16. It will be observed that a greater quantity of such dried latex is present. At the elevated temperatures of molten metal pouring, latex component 16 has been volatilized to leave refractory particles 10 and 12 with enhanced porosity being created by the removal of latex 16. Thus, the vapors formed from the volatilized consumable pattern can escape easier and more completely, thus, reducing the opportunity for liquid styrene to be trapped at the casting/coating interface.

While the incorporation of additional latex into consumable pattern coating slurries is preferred because of the presence of the latex in conventional consumable pattern coating slurries, it should be understood that some conventional consumable pattern coating slurries utilize particulate polymers (that are not film-forming at room temperature) rather than a latex. Thus, another aspect of the present invention is based upon the addition of water-miscible or water-thinnable polymers (i.e., a stable dispersion of the polymers) to achieve the high levels taught herein. Such water-miscible polymers (homopolymers and copolymers) can include a wide variety of organic polymers such as, for example, alkyd resins, vinyl polymers, acrylic polymers, polyesters, epoxy resins, polyurethanes and related isocyanate-derived polymers, amine- and phenol-formaldehyde resins, polyamides, polyimides, polysulfones, and the like and even mixtures thereof. There would seem to be no limit to the polymer compositions useful in the present invention.

It would be advantageous to utilize the same organic polymer already in the consumable pattern coating slurry when modifying a conventional consumable pattern coating slurry in accordance with the precepts of the present invention, but such utilization is not required so long as the properties of the consumable pattern coating slurry are not materially adversely altered. In this regard, a stable consumable pattern coating slurry is required whether it is called a solution, dispersion, slurry, or other name. What is required is that a water-based consumable pattern coating formulation is stable under conditions required for its use. When formulating a consumable pattern coating slurry from scratch, selection of the appropriate polymer or latex can be made based on other factors such as, for example, cost, manufacturing ease, performance with the consumable pattern, type of metal being cast, etc.

The remaining ingredients in the inventive consumable pattern coating slurries are maintained conventionally in type and amount. Thus, inorganic components useful in forming the inventive consumable pattern coating slurries of the present invention include, for example, aluminosilicate refractories, mica,, bauxite, amorphous silicas, cristobalite, quartz, and the like and mixtures thereof. For additional discussion of refractory ceramics that may find use in the present invention reference is made to *Ullmann's Encyclopedia of Industrial Chemistry,* Volume A23, pp 1 et seq., VCH Publishers, Inc. (1993), the disclosure of which is expressly incorporated herein by reference. The latex components can be made from a wide variety of vinyl and acrylic polymers and copolymers conventionally used in this field.

See, for example, Solomon, *The Chemistry of Organic Film Formers,* Robert E. Krieger Publishing Company, Huntington, N.Y. (1977), the disclosure of which is expressly incorporated herein by reference. Heretofore, the amount of such aqueous latex emulsion component in consumable pattern coating slurries ranged from about 4 wt-% up to about 12 wt-% on a non-volatile solids basis. Other additives in the inventive consumable pattern coating are kept to a minimum due to the sacrificial nature of such coatings in use.

Formulating such inventive consumable pattern coating slurries typically requires mere mixing of the ingredients, ordinarily at room temperature, though slightly elevated temperatures can be tolerated. The consumable polystyrene (or polystyrene copolymers or other consumable pattern material) is dipped into the inventive consumable pattern coating slurry and dried at room temperature or slightly elevated temperature with forced air drying often used. Thereafter, the pattern is placed in conventional foundry silica sand or other foundry aggregate and the casting process is practiced in conventional fashion, such as described in the background art cited above. Iron and aluminum are the metals that have been cast commercially according to the lost foam process, though this should not be construed as a limitation on the present invention.

The following examples show how the present invention has been practiced, but should not be construed as limiting. All references cited herein are expressly incorporated herein by reference.

EXAMPLES

Example 1

A commercially available consumable pattern coating (CERAMCOTE EP9 SA slurry; water (51–66 wt-%), silica/alumina ceramic (13–28 wt-%), mica (6–21 wt-%), cellulose (1–11 wt-%), vinyl acrylic copolymer (1–10 wt-%), magnesium aluminosilicate (1–9 wt-%); specific vapor density of >1.000 (17.500 mm Hg @ 68° F.), liquid density of 1.250 kg/l @ 25° C., 53–57% volatiles, pH of 6.8 7.8; a semi-liquid smooth blue slurry, Ashland Chemical Co., Dublin, Ohio) was modified in accordance with the present invention and compared to the unmodified coating in order to demonstrate the improvements lowering lustrous carbon formation. Dicalite SP5 silica powder was added at 5 wt-% to the EP9 SA slurry and the mixture divided into two aliquots. Additional vinyl acrylic copolymer (the latex already present in the slurry) was added to one of the aliquots so that it contained about 36.1 wt-% vinyl acrylic copolymer solids. Each coating formulation was diluted to several viscosities for testing.

Polystyrene foam test patterns then were dipped into each of the different viscosity coatings, dried, placed in sand, and molten iron poured. The resulting iron castings were evaluated for casting quality (based on a rating of 0 to 5, with 0 being perfect and 5 being given to a casting made with the unmodified EP9 SA slurry). The dried unmodified slurry was calculated to contain 6.14 wt-% resin solids content while the modified (inventive) slurry was calculated to contain 46.1 wt-% resin solids content. The following results were recorded.

TABLE 1

| Viscosity[1] | Casting Quality | |
|---|---|---|
| (cp) | Unmodified Slurry | Modified Slurry |
| 1090 ± 10 | 4 | 3 |
| 738 ± 3 | 4 | 2.5 |
| 433 ± 5 | 1.5[2] | 0.5[2] |

[1]centipoises @ 20 rpm
[2]bottom of casting had minor metal penetration

The above-tabulated results demonstrate that at each viscosity tested casting quality was improved for consumable patterns coated with the latex-rich slurries. The unmodified slurry (EP9 SA plus SP5) was not able to eliminate lustrous carbon defects. Lowering the slurry viscosity further would have resulted in severe metal penetration. Patterns coated with the latex rich modified slurry at the lowest viscosity tested resulted in a near-perfect casting (almost no lustrous carbon defects). Thus, the formulation of consumable pattern coatings to contain a high concentration of latex (solids) is demonstrated to improve casting quality.

Example 2

In this example, another commercially-available consumable pattern coating was evaluated (CERAMCOTE EP9 511 slurry; water (37–52 wt-%), bauxite (27–42 wt-%), mineral filler (1–15 wt-%), amorphous silica (1–10 wt-%), polysaccharide (1–10 wt-%), acrylic polymer (1–9 wt-%), cristobalite (0.1–8 wt-%), quartz (0.1–0.8 wt-%); vapor pressure of 17.5 mm Hg @ 68° F., specific gravity of 1.56 @ 77° F., liquid density of 1.56 kg/l @ 25° C., 40–45% volatiles, smooth tan slurry; Ashland Chemical Co., Dublin, Ohio). To the EP9 511 slurry was added 34.41 wt-% of the acrylic polymer (50% solids) already in the EP9 511 slurry. Patterns were formed, dipped, and castings made as described in Example 1. The dried unmodified coating was calculated to have 2.7 wt-% resin solids content while the modified (inventive) dried coating was found to have 26 wt-% resin solids content. The following results were recorded.

TABLE 2

| Viscosity[1] | Casting Quality | |
|---|---|---|
| (cp) | Unmodified Slurry | Modified Slurry |
| 2335 | 3 | — |
| 848 ± 13 | 0.75 | 0.75 |
| 598 ± 12 | 1.5[2] | 0.25[3] |

[1]centipoises @ 20 rpm
[2]casting had severe burn-on, not believed to be coatings related.
[3]casting had veining, not believed to be coatings related.

These results are consistent with the results reported in Example 1. The conventional EP9 511 slurry was a much better performing coating than the EP9 SA slurry tested in Example 1. Thus, the difference in test results is not as dramatic in this example. Nevertheless, the modified (inventive) slurry at the lowest viscosity resulted in the least lustrous carbon formation. These results also suggest that the type of latex emulsion added to the consumable pattern coating is of far less importance in improving lustrous carbon defects compared to the amount of latex emulsion added.

We claim:

1. An improved coated pattern for casting metal by a lost foam process which pattern is formed from a consumable pattern adapted to be decomposed and replaced by molten metal to form a casting, the improvement which comprises said coating being the dried residue of an aqueous coating formed from water, refractory particles, and from between about 25 wt-% and 75 wt-% organic polymer on a non-volatile solids basis, whereby lustrous carbon is reduced when casting iron.

2. The improved coated pattern of claim 1, wherein said consumable pattern is formed from only polystyrene.

3. The improved coated pattern of claim 1, wherein said refractory particles include one or more of mica, aluminosilicate ceramics, bauxite, amorphous silicas, cristobalite, and quartz.

4. The improved coated pattern of claim 1, wherein said organic polymer is a latex.

5. The improved coated pattern of claim 4, wherein said latex is an aqueous vinyl latex.

6. An improved process for casting metal by a lost foam process which includes forming a consumable pattern adapted to be decomposed and replaced by molten metal and coating the consumable pattern with an aqueous coating, the improvement which comprises coating said consumable pattern with an aqueous coating formed from water, refractory particles, and from between about 25 wt-% and 75 wt-% organic polymer on a non-volatile solids basis, whereby lustrous carbon is reduced when casting iron.

7. The improved process of claim 6, wherein said consumable pattern is formed from only polystyrene.

8. The improved process of claim 6, wherein said aqueous coating is formed to include refractory particles which include one or more of mica, aluminosilicate ceramics, bauxite, amorphous silicas, cristobalite, and quartz.

9. The improved process of claim 6, wherein said organic polymer is an aqueous latex.

10. The improved process of claim 9, wherein said aqueous latex is an aqueous vinyl latex.

11. An improved process for casting iron by a lost foam process which includes forming a consumable pattern adapted to be decomposed and replaced by molten iron and coating the consumable pattern with an aqueous coating, the improvement for reducing lustrous carbon which comprises coating said consumable pattern with an aqueous coating formed from water, refractory particles, and from between about 25 wt-% and 75 wt-% organic polymer on a non-volatile solids basis.

12. The improved process of claim 11, wherein said consumable pattern is formed from only polystyrene.

13. The improved process of claim 11, wherein said aqueous coating is formed to include refractory particles which include one or more of mica, aluminosilicate ceramics, bauxite, amorphous silicas, cristobalite, and quartz.

14. The improved process of claim 11, wherein said organic polymer is an aqueous latex.

* * * * *